United States Patent [19]

Oku et al.

[11] Patent Number: 4,663,560

[45] Date of Patent: May 5, 1987

[54] MAGNETIC FOCUS AND ELECTROSTATIC DEFLECTION TYPE IMAGE PICK-UP TUBE

[75] Inventors: Kentaro Oku, Kodaira; Masakazu Fukushima, Hinode, both of Japan

[73] Assignees: Hitachi, Ltd; Hitachi Denshi Kabushiki Kaisha, both of Tokyo, Japan

[21] Appl. No.: 668,844

[22] Filed: Nov. 6, 1984

[30] Foreign Application Priority Data

Nov. 7, 1983 [JP] Japan ..... 58-207379

[51] Int. Cl.[4] ..... H01J 29/78; H01J 31/36

[52] U.S. Cl. ..... 313/390; 313/432

[58] Field of Search ..... 313/390, 421, 432, 434, 313/435, 436, 439

[56] References Cited

U.S. PATENT DOCUMENTS

| | | | |
|---|---|---|---|
| 2,681,426 | 6/1954 | Schlesinger | 313/432 X |
| 2,830,228 | 4/1958 | Schlesinger | 313/432 X |
| 2,904,712 | 9/1959 | Schlesinger | 313/435 |
| 3,601,648 | 8/1971 | Uno | 313/421 |

FOREIGN PATENT DOCUMENTS

| | | | |
|---|---|---|---|
| 54-121662 | 9/1979 | Japan | 313/432 |

*Primary Examiner*—Palmer C. DeMeo
*Assistant Examiner*—Sandra L. O'Shea
*Attorney, Agent, or Firm*—Antonelli, Terry & Wands

[57] ABSTRACT

A magnetic focus and electrostatic deflection type image pick-up tube in which electrostatic deflection electrodes assuming a cylindrical shape as a whole are twisted about the axis of the cylinder at an angle selected so as to range from 21° to 60°. The spot of the electron beam is less enlarged in an oval shape at the corners of target in the imaging tube.

6 Claims, 11 Drawing Figures

MAGNETIC FOCUS AND ELECTROSTATIC DEFLECTION TYPE IMAGE PICK-UP TUBE

The present invention relates to a magnetic focus and electrostatic deflection, hereinafter referred to as MS, type image pick-up tube, and particularly to the structure of electrostatic deflection electrodes which limit the size of the electron beam spot that broadens when the electron beam is deflected, which reduce the ellipticity, and which reduce the dependency of resolution upon the place or direction on a TV raster.

In the accompanying drawings:

FIG. 1 is a schematic diagram illustrating the structure of an MS-type imaging tube.

Figure 1:
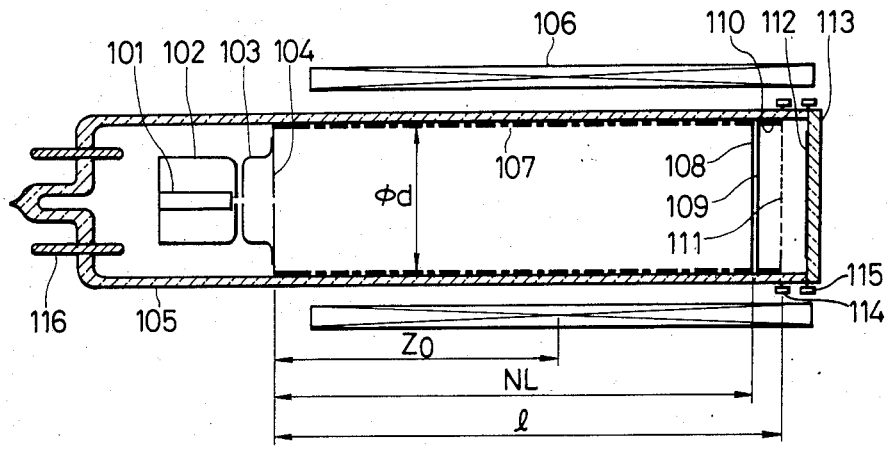
FIG. 1 is a schematic section view of an MS-type imaging tube.

Electrons emitted from the cathode 101 are controlled by a first grid 102, accelerated by a second grid 103, and are transformed into a fine electron beam through a beam defining aperture formed at the center of a beam disc 104. The three electrodes consisting of cathode 101, first grid 102 and second grid 103, constitute an electron beam generator, i.e., constitute an electron gun. The electron beam from the electron gun is focused on a photoconductive target 112 relying upon the function of the magnetic field established by a focusing coil 106 that surrounds a cylindrical glass envelope 105 in concentric relation therewith. At the same time, owing to the function of the electric field established by electrostatic deflection electrodes 107 formed on the inner wall of the glass envelope 105, the electron beam scans the photoconductive target 112 to read out the electrical signals corresponding to an optical image from the photoconductive target. Further, provision is made for an electrostatic lens or a so-called collimating lens consisting of deflection electrodes 107 and a fourth grid 110 in the shape of a cylindrical ring having a mesh electrode 111, in order to remove velocity components of diametral direction from the deflected electron beam, such that the electron beam will fall on the photoconductive target as perpendicularly as possible. Here, reference numeral 108 denotes a final end of the deflection electrodes 107, and reference numeral 109 denotes a starting end of the fourth grid 110.

The electrodes constituting the electron beam generator, deflection electrodes and collimating leans, are arranged concentrically in the glass envelope 105. The photoconductive targe 112 is provided inside a face plate 113 that is provided at the end of the glass tube 105 via an indium ring 115. The fourth grid 110 is secured in the glass envelope via an indium ring 114. The glass envelope 105 is sealed by a stem having pins 116.

Figure 2:
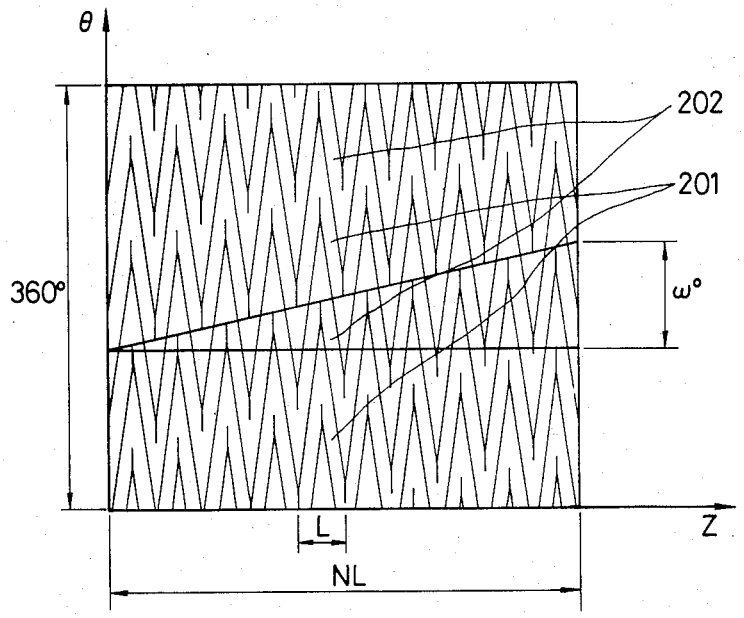
FIG. 2 is an expanded view of electrostatic deflection electrodes according to the present invention.

The electrostatic deflection electrodes 107 for scanning the electron beam consist of a pair of zigzag horizontal deflection electrodes 201 and a pair of vertical deflection electrodes 202 of the same shape as shown in the expanded view of FIG. 2. These horizontal and vertical deflection electrodes are alternately arranged and are interleaved relative to one another. FIG. 2 is an expanded view showing an example of electrostatic deflection electrodes in the imaging tube according to the present invention. For clarity, the electrostatic deflection electrodes will be described below briefly. In FIG. 2, Z represents a coordinate in the direction of tubular axis, $\theta$ represents the angle in the cylindrical coordinates, the repetitive pitch of the zigzag pattern is denoted by L, the number of repetitions is denoted by N, the overall length of the deflection electrode is denoted by NL, and the deflection electrode has a twist angle $\omega°$; the clockwise, i.e., right hand, twist relative to the direction in which the electron beam travels is regarded as positive.

Figure 3:
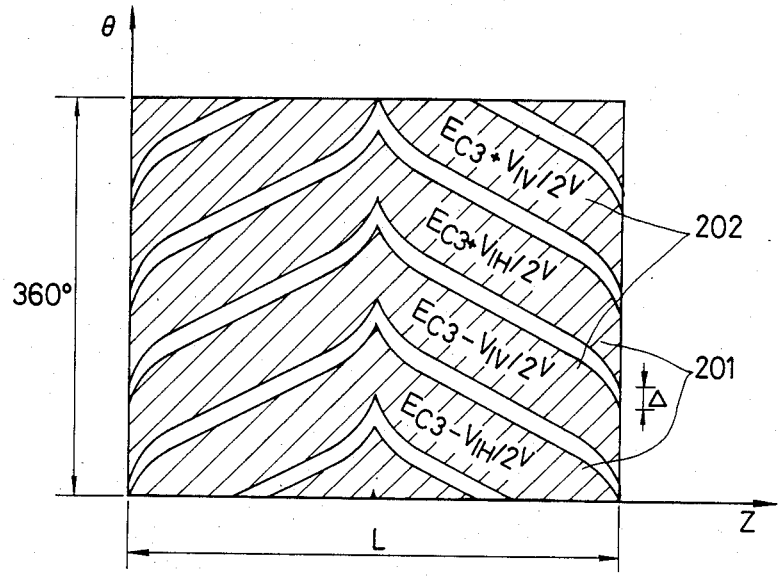
FIG. 3 is an expanded view of electrostatic deflection electrodes of one pitch.

FIG. 3 is an expanded view of the zigzag pattern of one pitch that is enlarged in the Z-direction. Here, however, the electrode of a conventional pattern of a twist angle $\omega$ of 0° is shown. The dc component of the voltage to be applied to the deflection electrodes is $E_{C3}$ (V), and a voltage of an ac component of $\pm V_{IH}/2$ (V) is superposed on the horizontal deflection electrode, and a voltage of an ac component of $\pm V_{IV}/2$ (V) is superposed on the vertical deflection electrode. Among the deflection electrodes, there exist slits $\Delta°$ in the $\theta$-direction for insulation.

In the conventional MS-type imaging tube, some electrostatic deflection electrodes do not have twist, but some have a twist angle $\omega$ of 90° along the direction in which the beam travels to increase deflection sensitivity. For example, Japanese Patent Publication No. 31257/1982 discloses electrostatic deflection electrodes having a twist angle $\omega$ of 90°.

In general, in an electrooptical system consisting of a combination of a focusing magnetic field which is uniform in the direction of the tubular axis, and a uniform electric field for deflection that meets at right angles therewith, an ideal focus and deflection system has theoretically been established in which the electrons fall on the target perpendicularly without permitting the electron beam to be broadened by deflection i.e., without permitting the spot size of electron beam to increase at the target, and without landing error.

It is, however, difficult to realize such a uniform magnetic field and a uniform electrical field. For instance, a magnetic field which is uniform in the direction of the tubular axis can be realized with an endless solenoid coil. To form the optical image on the target, however, a focusing coil having an end surface near the target must be used. Therefore, uniformity is disturbed by the fringe effect. Furthermore, with deflection electrodes having a twist angle $\omega$ of 0°, the internal electric field for deflection is not uniform throughout because the length NL of the deflection electrodes is finite; because there is a limit to how much the pattern pitch L and the slit $\Delta$ between the deflection electrodes can be reduced and because the electric field for deflection is shunted by the mesh electrode 111 or beam disc 104 shown in FIG. 1. With an MS-type imaging tube using electrostatic deflection electrodes with a zero twist angle, therefore, the electron beam broadens or landing error develops at the time of deflection because the electromagnetic field is not uniform.

In an electrooptical system employing a magnetic field which is uniform in the Z-direction and an electric field for deflection which uniformly turns along the twist of deflection electrodes, however, the beam may be focused on the target without beam broadening or landing error caused by deflection if drift space, i.e., focus lens space in effect, is defined between the electron beam generating portion and the deflection electrodes as described in "Electron Trajectories in Twisted Electrostatic Deflection Yokes" by E. F. Ritz, IEEE, Vol. ED-20, No. 11, 1973, pp. 1042–1049.

However, the use of drift space increases tubular length. In an ordinary imaging tube, therefore, it is not practicable to use drift space. Therefore, if electrostatic deflection electrodes with a twist angle of 90° are used without drift space, electron beam broadening and landing error become significantly great at the time of deflection.

If the beam broadens at the time of deflection, resolution deteriorates from the center toward the corners of the TV raster.

Figure 4:
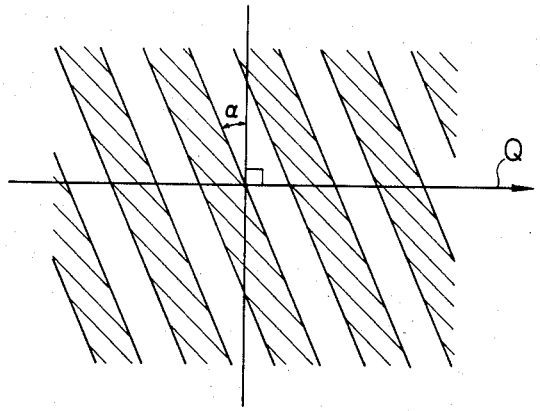
FIG. 4 is a diagram showing tilted stripe patterns.
Figure 5:
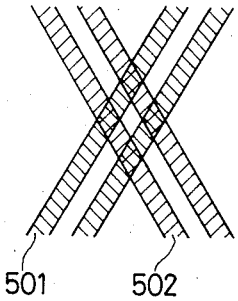
FIG. 5 is a schematic diagram of a color stripe filter of a frequency separation type imaging tube for a single tube color camera.

Further, if the beam does not broaden isotropically in the time of deflection, or if the beam spot assumes an oval shape due to astigmatism, the amplitude modulation factor, i.e., the ratio of amplitude of signal output when a tilted stripe pattern of a given spatial frequency is imaged to the amplitude of signal output when a tilted stripe pattern of a sufficiently low spatial frequency is imaged, of a tilted stripe pattern such as the one shown in FIG. 4, varies with the inclination $\alpha$ of the tilted stripe pattern. That is to say, the resolution varies with the direction. In FIG. 4, arrow Q indicates the scanning direction of beam. In particular, in a frequency separation type imaging tube for a single-tube color camera having two color stripe filters 501, 502, 501 being the red-cutting filter and 502 being the blue-cutting filter, with differently tilted stripes on the face plate 113 as shown in FIG. 5, the amplitude modulation factor varies relative to each color stripe filter if the electron beam assumes an oval shape, thereby causing non-uniform color in the TV raster.

If the landing error of the electron beam on the target is great, the signal output obtained from the target decreases from the center of the target toward the periphery thereof, and the so-called shading takes place.

The object of the present invention therefore is to provide an MS-type imaging tube which is capable of minimizing electron beam broadening and ellipticity at the time of deflection, and which reduces the dependency of the resolution upon the place or the direction in the TV raster.

To achieve the above-mentioned object according to the present invention, zigzag electrostatic deflection electrodes are twisted, with the twist angle ranging from 21° to 60°.

In the practical MS-type imaging tube as described above with reference to the conventional example, the broadening of the electron beam at the time it is deflected is not necessarily small since a uniform electromagnetic field is not realized when the twist angle $\omega$ is 0° and since drift space is not provided when the twist angle $\omega$ is 90°. To determine the extent of broadening, therefore, characteristics of the electron beam system were analyzed with a model very similar to the practical system of FIG. 1.

According to conventional analysis (e.g., "Trajectory Analysis of Electromagnetic Focus and Electrostatic Deflection Type Vidicon" by Kakizaki et al., Television Denshi Sochi Kenkyukai, ED-320, 1977, or "Electron Trajectories in Twisted Electrostatic Deflection Yokes", by E. F. Ritz, IEEE, Vol. ED-20, No. 11, 1973, pp. 1042–1049) employing a uniform electric field or an electric field which turns uniformly, the effect of collimating lens constituted by the electrostatic deflection electrode (the third grid) and the fourth grid could be studied only approximately; or the effect of shunting the deflection electric field with the beam disc and mesh electrode could be studied only approximately, and it was not possible to accurately determine the characteristics of the electron beam.

The inventors, however, have determined the electric field established by zigzag electrostatic deflection electrodes, the second grid and the fourth grid relying upon the variable separation method (see "Analysis of Electrostatic Deflection Type Image Pick-Up Tube [No. 1]" by Oku et al., Technical Report of the Association of Electronic Communications, June 24, 1983), calculated the electron trajectories inclusive of the effects of the collimating lens and the shunting of the deflection electric field, and analyzed the landing error of electrons and the broadening of electron beam that stems from the deflection aberration, and have also determined the diameter of the electron beam at the center and corners of the TV raster.

The landing error is evaluated in terms of the angle, the deviation from the perpendicular, at which the electrons are incident upon the photoconductive target, the electrons being emitted from the center of beam disc in the direction of the tubular axis and being deflected for effecting scanning. Since the magnetic field focuses the electron beam, the incident angle of electrons on the target has an angular component as well as a radial component.

When the twist angle $\omega$ is fixed, the radial component is chiefly determined by the voltage ratio $E_{C4}/E_{C3}$ of the collimating lenses, and the angular component is chiefly determined by the distance $Z_O$ of from the beam disc 104 to the central position of the focusing coil 106. Here, the ratio $E_{C4}/E_{C3}$ and the distance $Z_O$ were so selected that the angle of incidence of electrons on the target is nearly 0° when the electrons are deflected to the corner of the TV raster for each of the twist angles $\omega$. Here, $E_{C4}$ stands for the voltage of the mesh electrode 111.

The broadening of beam by deflection aberration is one of the factors for determining the diameter of the electron beam at the time of deflection, and is determined as described below.

First, the electric current flowing into the focusing coil is so adjusted that the r-coordinate of electrons will become zero on the target when no deflection is applied ($V_{IH}=V_{IV}=0$ V) to the electron group that is emitted from the center of the beam disc in a conical manner maintaining a given divergent angle, a half angle of 1.2° which is a representative value in the ordinary imaging tubes, at an angle $\theta$ of from 0° to 360°. Then the electron group is deflected, and landing positions of electrons on the target are connected to make a closed figure simular to a circle or an elipse. The circle or ellipse thus obtained is measured, and its size is taken as the broadening of the beam that stems from the deflection aberration.

In addition to the deflection aberration, the diameter of the beam in practice is also broadened by spherical aberration or by the effect of thermal spreading of the initial velocity of electrons. However, the beam diameter at the center of the target is determined by the latter two factors.

Figure 6A:
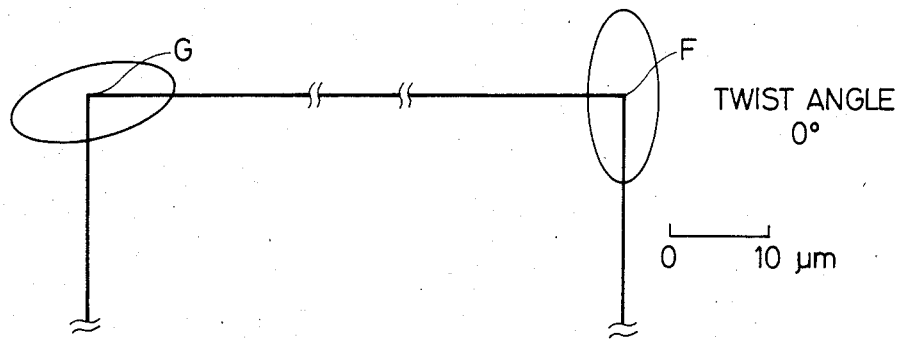
FIGS. 6A, 6B and 6C are diagrams showing the broadening of the electron beam caused by deflection aberration at a corner of a TV raster.
Figure 6B:
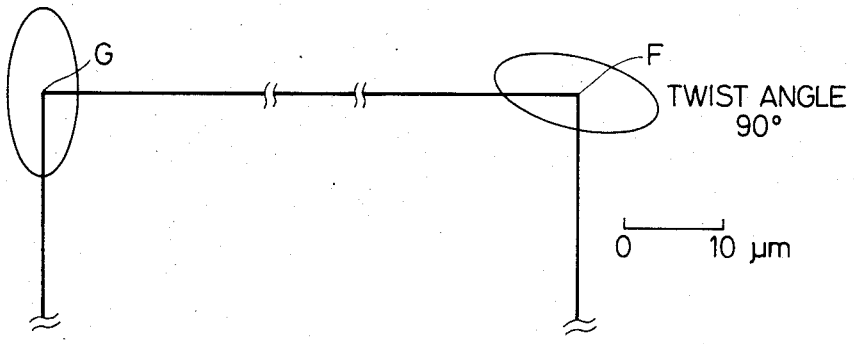
Figure 6C:
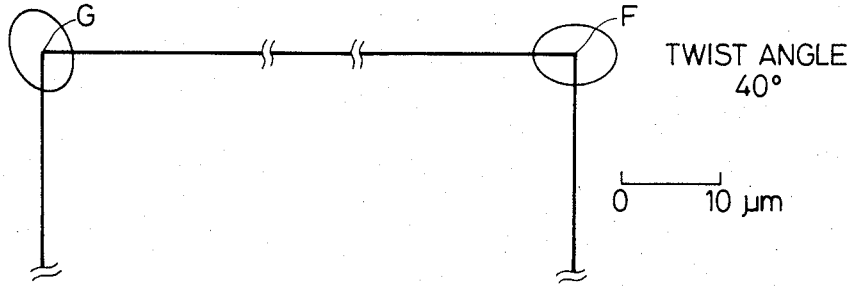

FIGS. 6A and 6B illustrate the results of analysis of beam spreading when the twist angles are 0° and 90°. In FIGS. 6A to 6C, the broadening of the electron beam is symmetrical being rotated by 180° with the tubular axis as the center. Therefore, only the corners at the right upper position F and the left upper portion G of the TV raster are shown. The deflecting electrodes used for the analysis have an inner diameter $\phi_d$ of 16 mm; scanning size is 6.6 mm×8.8 mm; the slit width $\Delta$ is 10°; the voltage $E_{C2}$ of the beam disc is 300 V; the average voltage $E_{C3}$ of the deflection electrodes is 300 V; the surface voltage $E_T$ of the photoconductive target is 5 V; and the magnetic field is oriented in the direction of the +Z direction. For the central position $Z_O$ of the focusing coil and the voltage $E_{C4}$ of the mesh electrode, $Z_O/l=0.6$ and $E_{C4}/E_{C3}=1.16$ for $\omega=0°$, and $Z_O/l=0.46$ and $E_{C4}/E_{C3}=1.86$ for $\omega=90°$. Here, l denotes a distance (60 mm) from the beam disc 104 to the mesh electrode 111.

When the twist angle is 0° as shown in FIG. 6A, the broadening of beam assumes an ellipse at the upper right corner F of the TV raster with the major axis being oriented perpendicularly, and assumes an ellipse at the upper left corner G of the TV raster with the major axis being oriented horizontally. When the twist angle is 90° as shown in FIG. 6B, broadening of the beam still forms an ellipse, but the major axis is at right angles to that of FIG. 6A. In both FIGS. 6A and 6B, the broadening of the beam is about 15 μm at the maximum; good characteristics are not obtained.

The inventors have given consideration to the fact that the directions of the major axis of beam broadening are at right angles to each other in FIGS. 6A and 6B, and have varied the twist angle $\omega$ as shown in FIG. 2 over a range of 0° to 90°, and the inventors have found that the broadening of the beam is rounded within a particular region.

An embodiment of the present invention will be described below in detail.

FIG. 6C shows the calculated results of beam broadening when the twist angle $\omega$ shown in FIG. 2 is 40°. The conditions of analysis are $Z_O/l=0.55$, and $E_{C4}/E_{C3}=1.43$. It will be understood from FIG. 6C that broadening of the beam is not only rounded but its size is also reduced.

Figure 7:
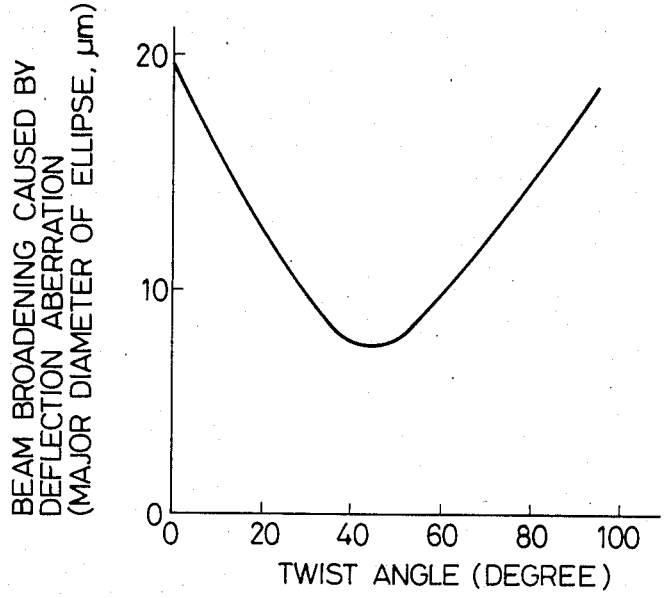
FIG. 7 is a diagram showing the broadening of the electron beam caused by deflection aberration at a corner of the TV raster with respect to the twist angle.

FIG. 7 shows a relation between the twist angle $\omega$ and beam broadening, the longest of the major diameters of broadening at four corners, at the corners of the TV raster. In this case, the central position Zo of the focusing coil and the voltage ratio $E_{C4}/E_{C3}$ of the collimating lens are so determined that the landing error of the electron beam is minimized when it is deflected to the corners. As will be understood from FIG. 7, there exists an optimum twist angle $\omega$ for the broadening of the beam caused by the deflecting aberration.

Figure 8:
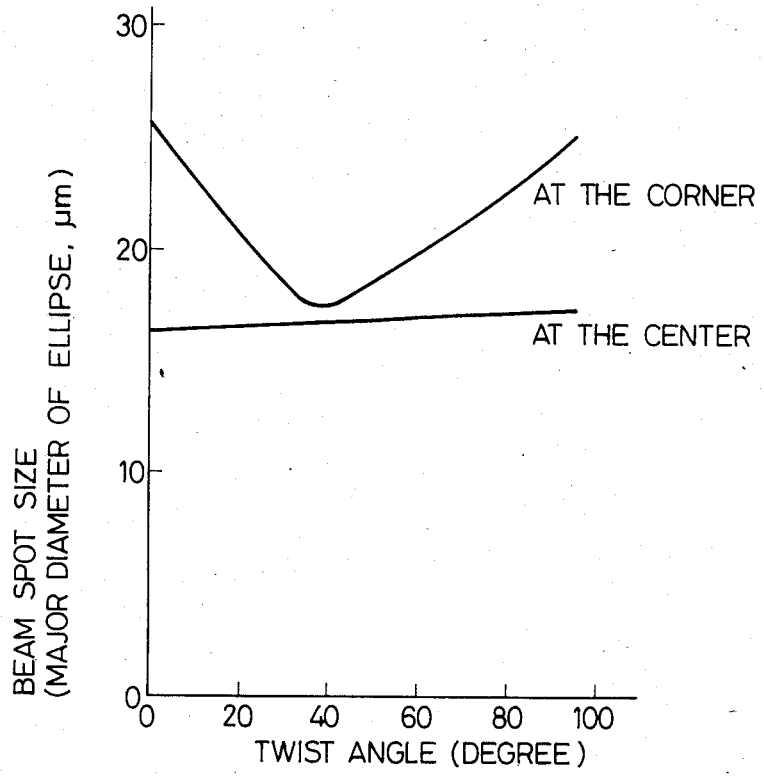
FIG. 8 is a diagram showing the electron beam spot diameters at the center and corner of the TV raster with respect to the twist angle.

In the above analysis, beam broadening based upon deflecting aberration only was calculated. As described already, however, the electron beam, in practice, is further broadened by spherical aberration of the electron lens and thermal spreading of initial velocity of electrons. By taking all three of these factors into consideration, the diameter (1/e diameter) of the electron beam was determined at the center and corners of the TV raster. FIG. 8 shows the results. For beam diameter at the corners, however, the longest of the major diameters at the four corners of the TV raster was shown. Representative operation conditions of the imaging tube were employed as the conditions of analysis; the cathode temperature was 1080° K.; the current density, i.e., cathode load, was 0.8 A/cm$^2$ at the center of the cathode; the beam current was 3.2 μA; the divergent angle of electrons from the beam disc was 1.2°.

It will be understood from FIG. 8 that the beam diameter at the center remains almost constant irrespective of the twist angle $\omega$, but there exists an optimum twist angle $\omega$ with regard to the beam diameter at the corner.

Figure 9:
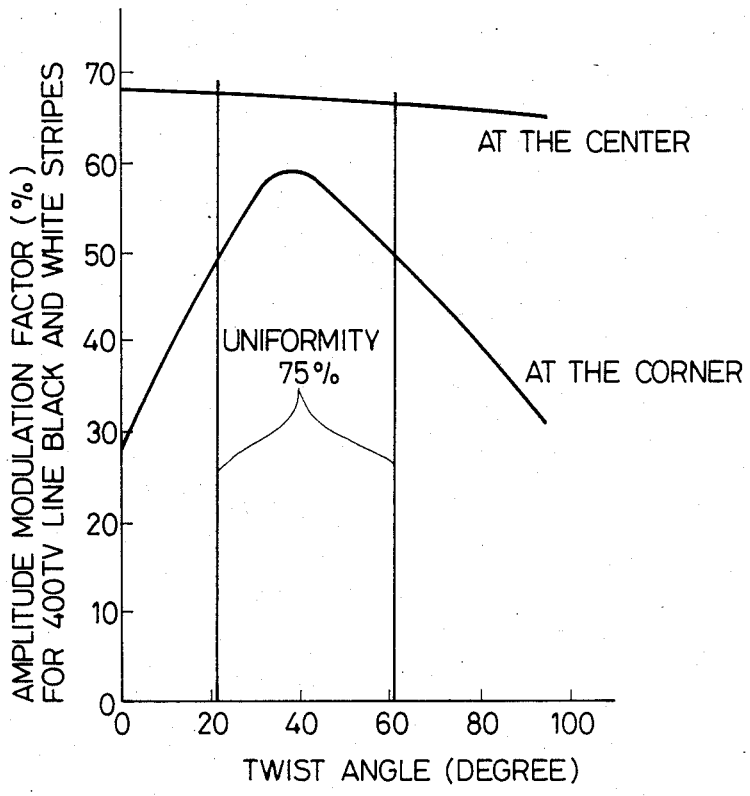
FIG. 9 is a diagram showing amplitude modulation factors at the center and corner of the TV raster with respect to the twist angle.

FIG. 9 shows the amplitude modulation factor which corresponds to the electron beam diameter of FIG. 8 when black and white stripes of 400 TV lines (in the $\frac{2}{3}$ inch tube, the length of half pitch of stripes is 6.6 mm/400=16.5 μm) are imaged. Uniformity in resolution of the imaging tube is usually represented by the ratio of the amplitude modulation factor at a corner to the amplitude modulation factor at the center when black and white stripes of 400 TV lines are imaged. In the frequency separation type imaging tube, for instance, this value should desirably be greater than 70%. If the range of twist angle $\omega$ is found by setting the allowable amount of uniformity to 75%, the preferred range of twist angle $\omega$ is, $$21° \leqq |\omega| \leqq 60°$$

for the electron beam diameter at the corner, as is obvious from FIG. 9.

The utilization of the absolute value of $\omega$ in the above expression is based upon the fact that calculations so far have been provided for the magnetic field oriented in the +Z direction, i.e., for a positive $B_Z$. For the magnetic field oriented in the −Z direction, the calculated results so far can be adapted if the right and left are totally inverted including the broadening of the electron beam as well as the deflection electrodes. Inversion of right and left in the deflection electrodes means reversal of the twist angle $\omega$ to $-\omega$, so that for a negative $B_Z$ the range of the optimized twist angle is negative.

According to the present invention as described in the foregoing, the twist angle of the electrostatic deflection electrodes shown in FIG. 2 is specified to make round and reduce the shape of electron beam spot deflected to the corner of the TV raster. Therefore, dependency of the resolution in the TV raster upon the direction can be reduced at the corners of the imaging tube, and uniformity of resolution can be improved in the TV raster. In particular, when the invention is applied to a frequency separation type imaging tube for a single tube color camera, color can be made more uniform in the TV raster and remarkable improvements can be obtained.

We claim:

1. A magnetic focus and electrostatic deflection type image pick-up tube comprising:

a cylindrical envelope;

an electron gun which is provided in said envelope and which generates a beam of electrons;

a target which is provided in said envelope and which is scanned by said electron beam;

a plurality of electrostatic deflection electrodes which are provided between said electron gun and said target in said envelope, and which assume a cylindrical shape as a whole; and a focusing coil which surrounds said envelope and which generates a magnetic field to focus said electron beam on said target;

wherein said electrostatic deflection electrodes are twisted about the axis of said cylinder from the ends on one side thereof to the ends on the other side thereof, and the twist angle of said electrostatic deflection electrodes is selected so as to range from 21° to 60°.

2. A magnetic focus and electrostatic deflection type image pick-up tube according to claim 1, wherein said plurality of electrostatic deflection electrodes are zigzag shaped and interleaved relative to each other, said zigzag shaped deflection electrodes being twisted at said selected twist angle about the axis of said cylinder so that tips of the zigzag shape of each of said deflection electrodes are positioned on a helical line turning around the axis of said cylinder from the end of one side of each of said deflection electrodes positioned proximate to said electron gun to the end of the side of each of said deflection electrodes positioned proximate to said target.

3. A magnetic focus and electrostatic deflection type image pick-up tube comprising:

a cylindrical envelope;

an electron gun which is provided in said envelope and which generates a beam of electrons;

a target which is provided in said envelope and which is scanned by said electron beam;

a plurality of electrostatic deflection electrodes which are interleaved relative to each other, which are zigzag shaped, which are provided between said electron gun and said target in said envelope, and which assume a cylindrical shape as a whole; and a focusing coil which surrounds said envelope and which generates a magnetic field to focus said electron beam on said target;

wherein said electrostatic deflection electrodes are twisted about the axis of said cylinder from the ends on one side thereof to the ends on the other side thereof, and the twist angle of said electrostatic deflection electrodes is selected so as to range from 21° to 60°.

4. A magnetic focus and electrostatic deflection type image pick-up tube according to claim 3, wherein said zigzag shaped deflection electrodes are twisted at said selected twist angle about the axis of said cylinder so tips of the zigzag shape of each of said deflection electrodes are positioned on a helical line turning around the axis of said cylinder from the end on one side of each of said deflection electrode positioned proximate to said electron gun to the end on the other side of each of said deflection electrodes positioned proximate to said target.

5. A magnetic focus and electrostatic deflection type image pick-up tube comprising:

a cylindrical envelope;

an electron gun which is provided in said envelope and which generates an electron beam;

a target which is provided in said envelope and which is scanned by said electron beam;

horizontal and vertical zigzag deflection electrodes which are alternatingly arranged, which are provided between said electron gun and said target in said envelope, and which assume a cylindrical shape as a whole; and a focusing coil which surrounds said envelope and which generates a magnetic field to focus said electron beam on said target;

wherein said deflection electrodes are twisted about the axis of said cylinder from the ends on one side thereof to the ends on the other side thereof, and the twist angle of said deflection electrodes is selected so as to range from 21° to 60°.

6. A magnetic focus and electrostatic deflection type image pick-up tube according to claim 5, wherein said zigzag shaped deflection electrodes are twisted at said selected twist angle about the axis of said cylinder so that tips of the zigzag shape of each of said deflection electrodes are positioned on a helical line turning around the axis of said cylinder from the end on one side of each of said deflection electrode positioned proximate to said electron gun to the end on the other side of each of said deflection electrodes positioned proximate to said target.

* * * * *